US008212170B2

(12) United States Patent
Horikoshi et al.

(10) Patent No.: US 8,212,170 B2
(45) Date of Patent: Jul. 3, 2012

(54) PUSH SWITCH

(75) Inventors: Takashi Horikoshi, Tokyo (JP); Masanori Endo, Tokyo (JP)

(73) Assignee: Niles Co., Ltd., Tokyo (JP)

( * ) Notice: Subject to any disclaimer, the term of this patent is extended or adjusted under 35 U.S.C. 154(b) by 307 days.

(21) Appl. No.: 12/659,147

(22) Filed: Feb. 26, 2010

(65) Prior Publication Data

US 2010/0224472 A1 Sep. 9, 2010

(30) Foreign Application Priority Data

Mar. 9, 2009 (JP) ..... 2009-054434

(51) Int. Cl.
*H01H 1/14* (2006.01)

(52) U.S. Cl. ..... 200/534; 200/243; 200/250; 200/540

(58) Field of Classification Search ..... 200/534, 200/540, 239, 243, 248, 250, 342
See application file for complete search history.

(56) References Cited

U.S. PATENT DOCUMENTS 3,699,276 A * 10/1972 Atakkaan ..... 200/16 A
4,421,959 A * 12/1983 Chen et al. ..... 200/16 A
4,616,117 A * 10/1986 Kleine ..... 200/243
4,650,935 A * 3/1987 Ootsuka et al. ..... 200/16 A
5,359,163 A * 10/1994 Woodard ..... 200/249

FOREIGN PATENT DOCUMENTS

JP 2005-149739 A 6/2005

* cited by examiner

*Primary Examiner* — Xuong Chung Trans
(74) *Attorney, Agent, or Firm* — Rader, Fishman & Grauer PLLC

(57) ABSTRACT

A movable contact point board provided with contact points is urged in a direction of being away from stationary contact points by return springs each having the same size and the same characteristic, and is arranged as opposed to the stationary contact points. Return springs have the respective ends for supporting locations in the movable contact point board which are away from each other as having the contact points in the movable contact point board therebetween and support heights of the return springs at the stationary side differ with each other by D. When a plunger equipped with a holding portion having a flat surface as a bottom surface presses the movable contact point board, the contact point in the movable contact point board gets in contact with the stationary contact point at an inclined posture. Thereafter, while the movable contact point board becomes perpendicular to the axial direction, a contacting point between the contact point in the movable contact point board and the stationary contact point varies to perform the wiping function.

6 Claims, 4 Drawing Sheets

PUSH SWITCH

CROSS-REFERENCE TO RELATED APPLICATION

This application is based on Japanese Patent Application No. 2009-054434 filed on Mar. 9, 2009, the disclosure of which is incorporated herein by reference.

BACKGROUND INVENTION

1. Field of the Invention

The present invention relates to a push switch constructed so that a stroke of a movable contact point arranged away from a stationary contact point is performed on an opposing line thereof to be in contact with each other, thereby closing an electrical circuit.

2. Description of Related Art

Japanese Patent Laid-Open No. 2005-149739 discloses this type of conventional push switches. This push switch is attached to a brake pedal for a vehicle, and an operation shaft pushed into a case of the push switch retains a movable contact point to be positioned away from a stationary contact point in an attaching state of the push switch. When the brake pedal is depressed, the operation shaft is moved in a direction outside of the case so that the movable contact point urged by a contact pressure spring is configured to be moved for being in contact with the stationary contact point. Here, the movable contact point includes two contact points an intermediate portion of which is urged by one contact pressure spring.

At the time of operating the push switch, respective opposing surfaces of the movable contact point and the stationary contact point vertically approach with each other or move away from each other. However, there occurs quite often a case where wear debris are produced between the opposing surfaces of the movable contact point and the stationary contact point or arc is discharged between the contact points caused by the operation of the push switch to deposit carbide or oxide therein, thereby forming an insulating film between the contact points. In consequence, this case may cause a so-called contact failure, thereby possibly creating an unstable operation of the push switch.

Therefore, the aforementioned conventional push switch is constructed so that immediately before the movable contact point gets in contact with the stationary contact point, a flexible member causes the movable contact point to move laterally to the stroke direction. In consequence, this lateral movement acts to perform wiping on the contact surfaces of the contact points with each other for removing wear debris, carbide, oxide and the like (hereinafter, collectively referred to as foreign matter).

The aforementioned conventional push switch is, however, provided with a contact pressure spring 15 for wiping the contact surfaces of the contact points and further, a flexible member 18 as a different member. In other words, the above conventional push switch needs two kinds of components, and is, therefore, high in manufacturing costs and also leads to an increase in managing costs after all.

The above push switch is configured in the form where when the operation shaft moves in a direction outside of the case, the movable contact point gets in contact with the stationary contact point, but the structure in which when the operation shaft (push rod) is pushed in, the movable contact point gets in contact with the stationary contact point raises also the similar problem.

In view of the above, there exists a need for a push switch which overcomes the above-mentioned problem in the related art. The present invention addresses this need in the related art as well as other needs, which will become apparent to those skilled in the art from this disclosure.

SUMMARY OF THE INVENTION

Therefore, the present invention is made in view of the foregoing problems and it is an object of the present invention to provide a push switch which can obtain a stable switching operation by removing foreign matters on and between the contact surfaces of contact points without additional management jobs and costs.

According to an aspect of the present invention, a push switch which performs a stroke of a movable contact point to a stationary contact point to open/close an electrical circuit therebetween comprises a first spring, and a second spring having the same size and the same characteristic as those of the first spring, the first spring and the second spring being arranged between a movable contact point board having the movable contact point and a stationary member having the stationary contact point to urge both the movable contact point board and the stationary member to be positioned away from each other, wherein the first spring and the second spring have respective ends for supporting locations in the movable contact point board which are away from each other as interposing the movable contact points therebetween and the other respective ends set at support positions in the stationary member which are different in a direction of the movable contact point board; and the movable contact point board is pressed in a direction of the stationary contact point by the pressing surface of a pressing member.

According to the aspect of the present invention, a height of a support position of the first spring in the stationary member which is different from that of the second spring, and the movable contact point board supported by the first spring and the second spring performs a stroke thereof in an inclined posture. Accordingly, the movable contact point gets also in contact with the stationary contact point at the inclined posture, and thereafter, a contacting point between the movable contact point and the stationary contact point varies to perform wiping therebetween while the inclination angle of the movable contact point varies due to the pressing operation of the pressing member.

Therefore, the foreign matters on the contact surfaces of the movable and stationary contact points can be removed to obtain a stable switching operation. Further, the first spring and the second spring are formed of the two same springs, and therefore, the push switch can be realized at low costs without increasing the kind of the component.

BRIEF DESCRIPTION OF THE DRAWINGS

Other objects, features, and advantages of the present invention will become more apparent from the following detailed description made with reference to the accompanying drawings, in which like portions are designated by like reference numbers and in which.

DETAILED DESCRIPTION OF THE EXAMPLE EMBODIMENTS

Hereinafter, an embodiment of the present invention will be explained with reference with the drawings.

Figure 1:
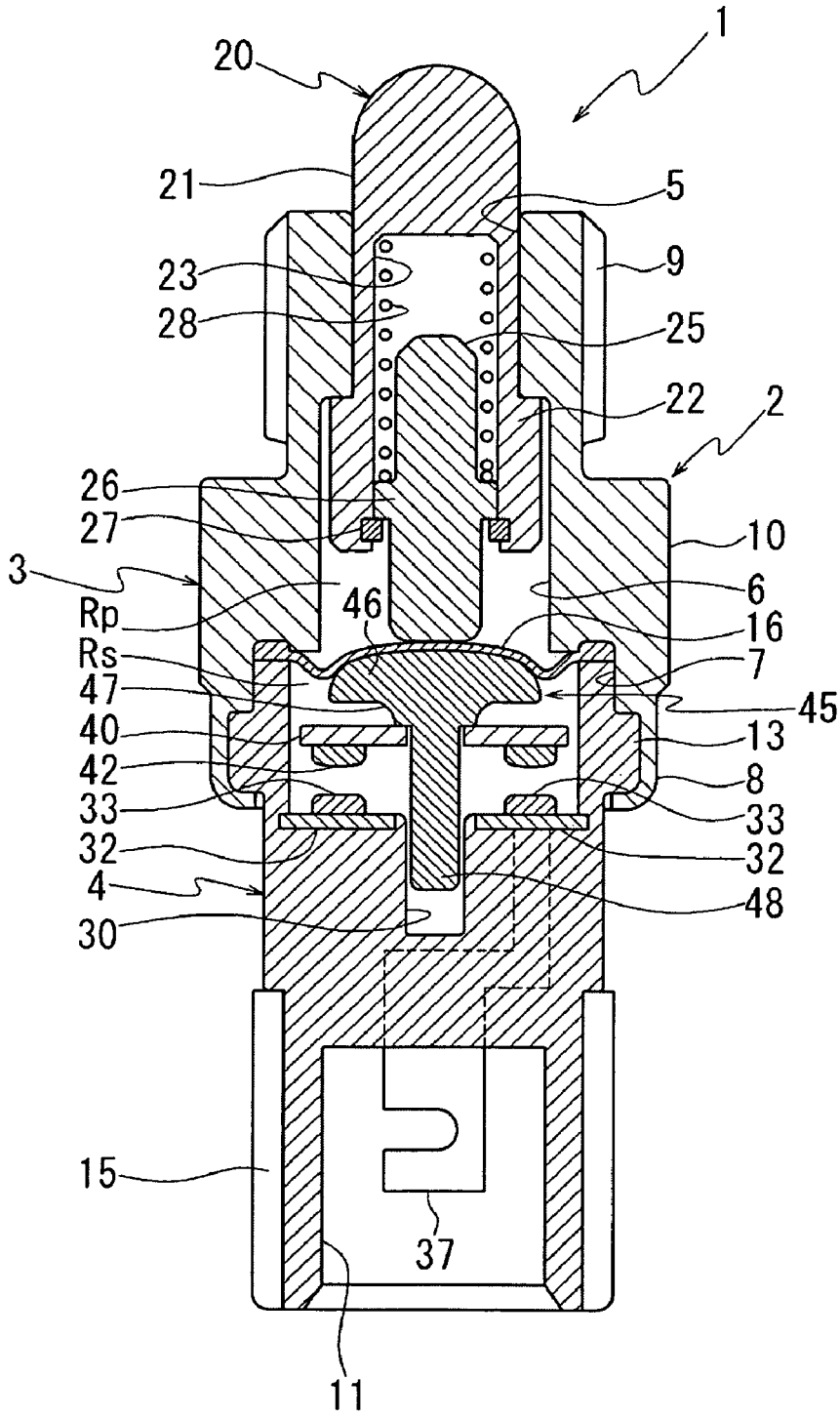
FIG. 1 is a longitudinal cross sectional view showing an entire construction of a push switch according to an embodiment in the present invention.
Figure 2:
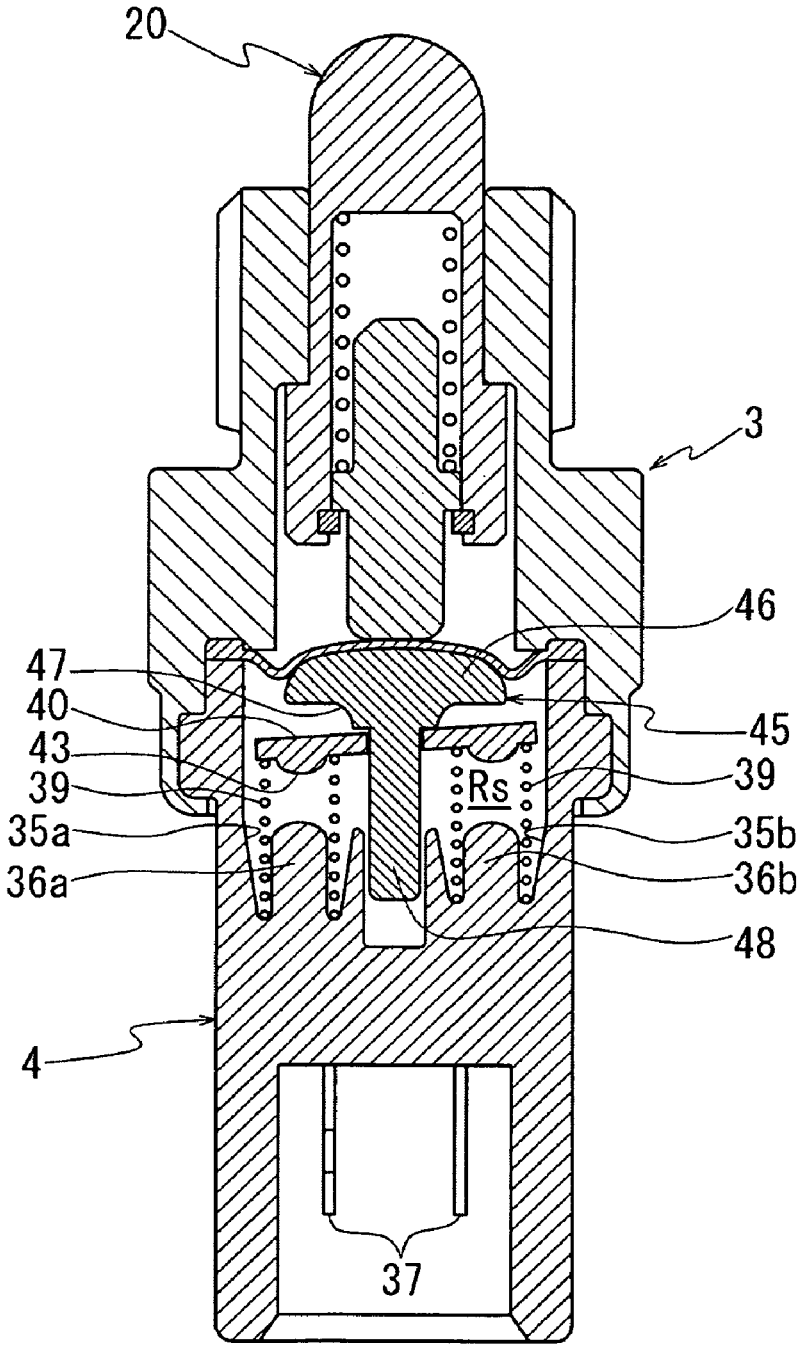
FIG. 2 is a longitudinal cross sectional view showing the push switch rotated by 90° around the shaft thereof to FIG. 1.

FIG. 1 is a longitudinal cross sectional view showing an entire construction of a push switch according to an embodiment in the present invention and FIG. 2 is a longitudinal cross sectional view showing the push switch rotated by 90° around the shaft thereof to FIG. 1. A push switch 1 is configured in such a manner that a movable contact point board 40 and a stationary contact point plate 32, which will be described later, are accommodated in a casing 2. The casing 2 is formed of a first case 3 and a second case 4. The first case 2 is made of metal and mainly accommodates a push rod 20 therein, and the second case 4 is made of resin and accommodates the movable contact point board 40 and the stationary contact point plate 32 therein, and further, forms a connector portion.

A push rod 20 is provided with a round shaft-shaped operation portion 21 and a collar portion 22 accommodated in the first case 3 and having a diameter larger than that of the operation portion 21. The operation portion 21 protrudes from a front end of the first case 3 outside thereof. It should be noted that this push switch 1 is a switch of a type which turns on by pushing the push rod 20 protruding from the casing 2. Each of FIGS. 1 and 2 shows a free state (OFF) where the push rod 20 protrudes from the casing 2.

The first case 3 is provided with a first bore 5 opened at a front end thereof, a second bore 6 communicating with the first bore 5, a third bore 7 connected to the second bore 6 formed therein, and finally a caulking portion 8 located in a rear end of the case 3 at the side of the second case 4. The first bore 5 guides the operation portion 21 of the push rod 20, the second bore 6 accommodates the collar portion 22 therein, the third bore has a diameter further larger than that of the second bore 6, and the caulking portion 8 has a thickness thinner than that of the rest. The first bore 5 and the second bore 6 constitute a push rod accommodating chamber Rp. An outer periphery of the first case 3 has a front end in which a screw portion 9 is formed and the first case 3 has a nut portion 10 formed between the screw portion 9 and the caulking portion 8.

The second case 4 is provided with a contact point accommodating chamber Rs opened at the side of the first case 3, and a reception concave portion 11 as a connector portion opened at the side opposing to the first case 3. An outer periphery of the second case 4 has a front end at the side of the first case 3, the front end having a diameter which conforms to the third bore 7 of the first case 3, and the second case 4 subsequently has a bulging portion 13 conforming to an inner diameter of the caulking portion 8. The first case 3 and the second case 4 are connected with each other by caulking the caulking portion 8 in such a manner as to accommodate and hold the bulging portion 13 inside the caulking portion 8. It should be noted that reference numeral 15 shows a fitting guide portion for an opponent connector (not shown).

The respective centers of the bores 5, 6, and 7, the caulking portion 8, the screw portion 9, the nut portion 10 and the like are arranged in a linear line on the shaft center of the entire push switch 1. A peripheral edge of a diaphragm 16 made of a resilient element is interposed between an open end surface of the contact point accommodating chamber Rs in the second case 4 and a shoulder (stepped portion) between the second bore 6 and the third bore 7 in the first case 3, thus performing sealing between the push rod accommodating chamber Rp and the contact point accommodating chamber Rs.

The push rod 20 is provided with a bore 23 formed therein which opens at a rear end surface of the collar portion 22 and a relay member 25 is retained in the bore 23. The relay member 25 is a round shaft which has a collar 26 in the middle portion in a longitudinal direction. An engagement of a snap ring 27 fitted into an open end of the bore 23 with the collar 26 restricts the relay member 25 not to come out of the bore 23. A spring 28 is provided between the collar 26 and a bottom wall of the bore 23, and the relay member 25 is urged in a coming-out direction (in a protruding direction toward the diaphragm 16) by the spring 28 to be seated on the snap ring 27.

Figure 3:
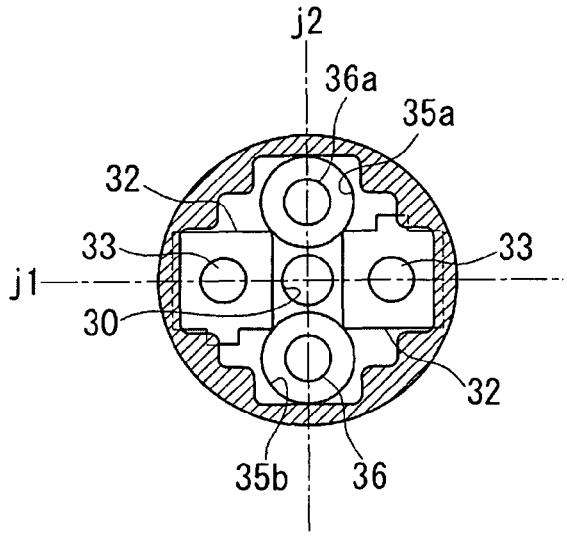
FIG. 3 is a view showing an arrangement of a stationary contact point plate and spring receiving portions in a bottom wall of a contact point accommodating chamber in the embodiment.

Two stationary contact point plates 32 each having a contact point 33 are arranged symmetrically on the bottom wall in the contact point accommodating chamber Rs in such a manner that a guide bore 30 is interposed between them. Further, spring receiving portions 35*a* and 35*b* are symmetrically formed in the bottom wall of the contact point accommodating chamber Rs in such a manner that the guide bore 30 is likewise interposed between them. A shown in FIG. 3, a line J1 connecting respective centers of the contact points 33 of the stationary contact point plates 32 is positioned at right angles to a line J2 connecting respective centers of the spring receiving portions 35*a* and 35*b* with each other. Each of the spring receiving portion 35*a* and 35*b* is formed in a concave portion shaped to be dug from the bottom wall of the contact point accommodating chamber Rs, and projections 36*a* and 36*b* are provided upright respectively in the centers of the spring receiving portions 35*a* and 35*b*.

The stationary contact point plate 32 is, as shown in FIG. 1, molded inside the resin of the second case 4 and extends into the reception concave portion 11. A front end thereof serves as a connector terminal 37. Return springs 39 and 39 each have the same characteristic, respective ends of which are retained in the spring receiving portions 35*a* and 35*b*, and are positioned by the projections 36*a* and 36*b*. Other ends of both the return springs 39 and 39 support the movable contact point board 40.

Figure 4:
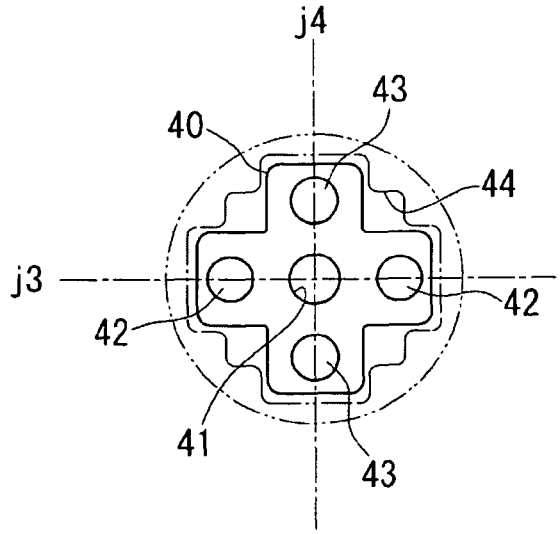
FIG. 4 is a view showing a movable contact point board as viewed from a bottom wall side of the contact point accommodating chamber in the embodiment.

FIG. 4 shows the movable contact point board 40 as viewed from the bottom wall side in the contact point accommodating chamber Rs. The movable contact point board 40 has a flat surface formed in a cross shape and is made of conductive metal. The movable contact point board 40 is provided with contact points 42 and 42 positioned symmetrically as having a through bore 41 formed in its center interposed in between and is likewise provided with spring receiving projections 43 and 43 positioned symmetrically as having the through bore 41 formed in its center interposed in between. A line j3 connecting centers of the contact points 42 and 42 is configured to be at right angles to a line j4 connecting centers of the spring receiving projections 43 and 43 with each other. That is, the spring receiving projections 43 and 43 are positioned away from each other as having the contact point 42 in between. A distance between the contact points 42 and 42 of the movable contact point board 40 is set to be equal to a distance between the contact points 33 and 33 of the stationary contact point plates 32. A distance between the spring receiving projections 43 and 43 of the movable contact point board 40 is set to be equal to a distance between the projections 36*a* and 36*b* in the bottom wall of the contact point accommodating chamber Rs.

Here, the two spring receiving portions 35*a* and 35*b* differ in depth in the axial direction (height position in the direction of the movable contact point board 40), and the spring receiving portion 35*b* right in FIG. 2 has a bottom position of the concave portion higher than that of the spring receiving portion 35*a* left in FIG. 2. Therefore, the movable contact point board 40 supported by the return springs 39 and 39 each having the same characteristic is inclined by a difference amount in height between the spring receiving portions 35*a* and 35*b*. However, the movable contact point board 40 is not inclined along a direction connecting the contact points 42 and 42 as shown in FIG. 1. It should be noted that guides 44 are formed on the side wall of the contact point accommodating chamber Rs for restricting rotation of the movable contact point board 40 around the shaft center.

A shaft portion 48 of a plunger 45 is inserted into the through bore 41 of the movable contact point board 40 and a front end of the shaft portion 48 is inserted into the guide bore 30 of the bottom wall in the contact point accommodating chamber Rs. A head portion 46 of the plunger 45 has a front surface at the side of the push rod 20 which is formed in a convex round shape and a back surface at the side of the shaft portion 48 constituting a holding portion 47 as a flat surface 49. The flat surface 49 of the holding portion 47 has a diameter larger that the shaft portion 48 and is perpendicular to the axial direction. The head portion 46 of the plunger 45 has the surface which abuts against the diaphragm 16.

In a free state in FIGS. 1 and 2, in the push rod 20, the collar portion 22 comes into contact with the shoulder (stepped portion) between the first bore 5 and the second bore 6 in the first case 3, the front end protrudes from the casing 2 and the relay member 25 is urged by the spring 28 as described above to be seated on the snap ring 27. Further, a rear end of the relay member 25 presses the head portion 46 of the plunger 45 through the diaphragm 16 and on the other hand, the movable contact point board 40 is pressed against the holding portion 47 of the plunger 45 by the return spring 39 and the contact point 42 is retained in a state of being away from the contact point 33 of the stationary contact point plate 32.

Here, a force of the spring 28 urging the relay member 25 in the direction of the plunger 45 is set larger than a force by which the two returns springs 39 and 39 urge the movable contact point board 40 in the direction of being away from the stationary contact point plates 32. It should be noted that, as described later, when the plunger 45 is further pushed down by the relay member 25, the movable contact point board 40 is pushed down by the holding portion 47 of the plunger 45, so that the contact point of the movable contact point board 40 gets in contact with the contact point of the stationary contact point plate 32. However, the guide bore 30 of the bottom wall in the contact point accommodating chamber Rs is sized to be deep to the extent that a front end of the shaft portion 48 of the plunger 45 does not abut against the bottom of the guide bore 30 until this point.

Figure 5:
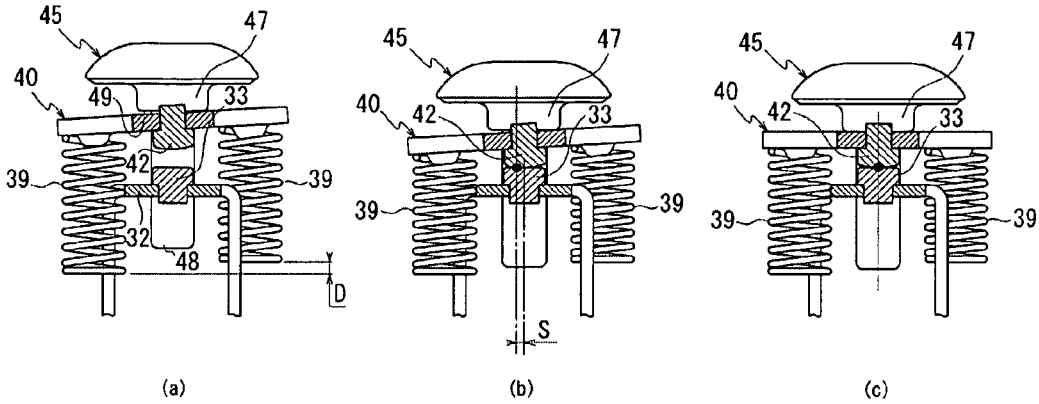
FIGS. 5A, 5B and 5C are diagrams showing the process of a switching operation in the embodiment.

Next, an operation of the push switch 1 constructed as above will be explained. FIGS. 5A, 5B and 5C show a relationship between the movable contact point board 40 in the contact point accommodating chamber Rs changing with movement of the plunger 45 and the stationary contact point plates 32. First, in a free state where the push rod 20 protrudes from the casing 2, the movable contact point board 40 is, as shown in FIG. 5A, at a position distant from the stationary contact point plate 32 and is inclined by being supported with the return springs 39 and 39 the arrangement heights of which are different by D. This state is the same as the state shown in FIG. 2.

In this state, there is not inclined a line which is at right angles to a line connecting the spring receiving projections 43 and 43 as load centers of the return springs 39 and 39 and which connects the contact points 42 and 42. Therefore, both the contact points 42 and 42 are positioned at the same height in this figure. Also in the subsequent process, the two contact points 42 and 42 are positioned at the same height.

When the push rod 20 is pushed down from this state in FIG. 1, a position of the snap ring 27 on which the collar 26 of the relay member 25 is seated goes down in a direction of being closer to the plunger 45. Then, since an urging force of the snap ring 27 is larger than an urging force of the return springs 39, the relay member 25 goes down together with the push rod 20 in a state where the collar 25 remains to be seated on the snap ring 27. Therefore, the plunger 45 pushed by the relay member 25 moves the movable contact point board 40 toward the stationary contact point plate 32 on the opposing line (that is, axially) at the inclined posture, and as a result, the contact points 42 of the movable contact point board 40 get in contact with the contact points 33 of the stationary contact point plates 32 at the inclined posture. FIG. 5B shows a moment the contact point 42 gets in contact with the contact point 33, wherein since an end surface of the contact point 42 is spherically formed, a contacting point (shown in a black circle in the figure) between the contact point 42 and the contact point 33 is shifted by S from a center of the contact point 33.

When the push rod 20 is further pushed down from this state to descend the plunger 45, the movable contact point board 40 changes the posture to a horizontal state (perpendicular to the axial direction) by being pushed with the holding portion 47. Followed by it, the movable contact point board 40 rolls around the contacting point between the contact point 42 of the movable contact point board 40 and the contact point 33 of the stationary contact point plate 32. As a result, when the movable contact point board 40 becomes in a horizontal state by being pushed with an entire lower end surface of the holding portion 47, the contacting point between the contact point 42 and the contact point 33, as shown in FIG. 5C, moves onto a center line of the contact point 33. In consequence, a wiping function occurs due to the rolling between the contact point 42 of the movable contact point board 40 and the contact point 33 of the stationary contact point plate 32. It should be noted that, when the push rod 20 is further pushed down after the movable contact point board 40 becomes in the horizontal state, the movable contact point board 40, the plunger 45, the diaphragm 16 and the relay member 25, which abut against each other, do not move in the axial direction any more, the spring 28 is elastically deformed to absorb a displacement of the push rod 20. Therefore, even in a case where the push rod 20 is forcibly pushed down more than necessarily, damages of the contact point portion are prevented.

In the present embodiment, the contact point 33 corresponds to the stationary contact point in the present invention and the contact point 42 corresponds to the movable contact point. In addition, the second case 4 (spring receiving portions 35*a* and 35*b* thereof) corresponds to the stationary member and one of the two return springs 39 and 39 corresponds to the first spring and the other corresponds to the second spring. Further, the plunger 45 corresponds to the pressing member, and also the flat surface 49 as the holding portion forms the pressing surface.

In the present embodiment constructed as above, in the push switch 1 in which the contact point 42 of the movable contact point board 40 is axially moved on the opposing line to the contact point 33 of the stationary contact point plate 32 so that the contact point 42 gets in contact with the contact point 33, the return springs each having the same size and the same characteristic are arranged between the movable contact point board 40 and the spring receiving portions 35*a* and 35*b* to urge both of the movable contact point board 40 and the spring receiving portions 35*a* and 35.*b* so as to be away from each other, wherein the return springs 39 and 39 have respective ends supported by the spring receiving projections 43 and 43 at locations in the movable contact point board 40 away from each other as interposing the contact points 42 and 42 in the movable contact point board 40 therebetween, height positions of the spring receiving portions 35*a* and 35*b* supporting the other respective ends differ with each other, and the movable contact point board 40 is pressed by the holding portion 47 provided with the pressing surface of the plunger 45. Thereby, the contact point 42 of the movable contact point board 40 is in contact with the stationary contact point 33 in the inclined posture, and thereafter, while an inclination angle of the movable contact point board 40 varies due to the pressing of the plunger 45, the contacting point between the contact point 42 and the contact point 33 varies to perform the wiping function. Therefore, the foreign matters on the contact surfaces can be removed to obtain the stable switching operation. In addition, since the return springs 39 and 39 of one kind only are used for urging and supporting the movable contact point board 40 in such a manner as to be away from the stationary contact point plate 32, the present embodiment can be realized at low costs without increasing the kind of the component.

Further, since the contact surface of the stationary contact point 33 is flat and the contact surface of the contact point 42 of the movable contact point board 40 is spherical, the contacting point of each other moves due to the rolling of the contact point 42 to produce a smooth wiping function.

In the case 2, the push rod accommodating chamber Rp in which the push rod 20 one end of which protrudes from the case 2 is arranged and the contact point accommodating chamber Rs in which the stationary contact points 33 and 33, the movable contact point board 40 and the like are arranged are defined by the diaphragm 16. Therefore, even if water or dusts enter into the push rod accommodating chamber Rp from the first bore 5 through which the push rod 20 penetrates, no influence thereof is imposed on portions of the contact points. In addition, the push rod 20 retains the relay member 25 therein which is urged in a direction of protruding toward the side of the diaphragm 16 by the spring 28 and is restricted in a protruding amount toward the side of the diaphragm 16, and further, a protruding end of the relay member 25 presses the head portion 46 of the plunger 45 through the diaphragm 16. Therefore, even if the push rod 20 is pushed down more than necessary, a displacement of the relay member 25 absorbs a displacement of the push rod 20 to prevent damages of the contact point portion.

In should be noted that in the present embodiment, the contact surface of the stationary contact point 33 is, as described above, made flat and the contact surface of the contact point 42 in the movable contact point board 40 is made spherical, but the present invention is not limited to this. The contact surface of each of both the contact points 33 and 42 may be formed of any cross sectional configuration. For example, the contact surface of the stationary contact point 33 may be made spherical and the contact surface of the contact point 42 in the movable contact point board 40 may be made flat.

In addition, the movable contact point board 40 has the two contact points 42 and 42 which are provided at the symmetrical positions as having the through bore 41 in between, but one contact point extending in a direction of a line j3 orthogonal to a line j4 connecting the spring receiving projections 43 and 43 may be provided at a portion of the through bore 41 of the movable contact point board 40 by eliminating the shaft portion 48 of the plunger 45.

The present invention can be used for various types of control devices provided with a push switch which turns on/off by performing a stroke of the pressing member. For example, the present invention is useful, particularly for detection of a brake pedal for a vehicle or the like.

While only the selected embodiment has been chosen to illustrate the present invention, it will be apparent to those skilled in the art from this disclosure that various changes and modifications can be made therein without departing from the scope of the invention as defined in the appended claims. Furthermore, the foregoing description of the embodiment according to the present invention is provided for illustration only, and not for the purpose of limiting the invention as defined by the appended claims and their equivalents.

What is claimed is:

1. A push switch comprising:

stationary contact points;

movable contact points provided as opposed to the stationary contact points;

springs for urging the stationary contact point and the movable contact point in such a manner as to be away from each other, moving the movable contact point to the stationary contact point to be in contact with the stationary contact point; and a pressing member for pressing a movable contact point board with a pressing surface thereof, wherein:

the springs comprise:

a first spring arranged between the movable contact point board having the movable contact point and a stationary member having the stationary contact point; and a second spring arranged between the movable contact point board having the movable contact point and the stationary member having the stationary contact point, wherein:

the first spring and the second spring have the same size and the same characteristic, and the first spring and the second spring have respective ends for supporting locations in the movable contact point board which are away from each other as interposing the movable contact points therebetween and the other respective ends set at support positions in the stationary member which are different in a direction of the movable contact point board; and the movable contact point board is pressed in a direction of the stationary contact point by the pressing surface of the pressing member.

2. A push switch according to any of claims 1, wherein:

one of a contact surface of the stationary contact point and a contact surface of the movable contact point is flat and the other is spherical.

3. A push switch comprising:

a case;

a push rod accommodating chamber and a contact point accommodating chamber defined in the case by a diaphragm;

a push rod, an end of which protrudes from the case, arranged in the push rod accommodating chamber;

stationary contact points provided in a bottom wall in the contact point accommodating chamber, the bottom wall being positioned away from the diaphragm;

a movable contact point board provided with movable contact points arranged as opposed to the stationary contact points in the contact point accommodating chamber;

a plunger accommodated in the contact point accommodating chamber, the plunger being provided with a head abutting against the diaphragm;

a first spring arranged between the movable contact point board and the bottom wall; and a second spring arranged between the movable contact point board and the bottom wall, wherein:

the first spring and the second spring have the same size and the same characteristic and the first spring and the second spring have respective ends for supporting locations in the movable contact point board which is away from each other as interposing the movable contact points therebetween and the other respective ends set at support positions in the bottom wall which are different in a direction of the movable contact point board;

the plunger includes a pressing portion provided with a pressing surface at the backside of the head portion, the pressing portion abutting against the movable contact point board urged by the first spring and the second spring; and movement of the push rod in association with the pushing-in of the push rod is transmitted through the diaphragm to the plunger to move the movable contact point board in a direction of the bottom wall, thus making the movable contact point be in contact with the stationary contact point.

4. A push switch according to claim 3, wherein:

the push rod is provided with a bore opened at the other end;

the bore retains a relay member therein which is urged in a direction of protruding from the other end and is restricted in a protruding amount; and the relay member includes a protruding end which presses the head portion of the plunger through the diaphragm.

5. A push switch according to any of claims 3, wherein:

one of a contact surface of the stationary contact point and a contact surface of the movable contact point is flat and the other is spherical.

6. A push switch according to any of claims 4, wherein:

one of a contact surface of the stationary contact point and a contact surface of the movable contact point is flat and the other is spherical.

* * * * *